United States Patent [19]

Eisenhawer et al.

[11] Patent Number: 4,648,835

[45] Date of Patent: Mar. 10, 1987

[54] STEAM GENERATOR HAVING A HIGH PRESSURE COMBUSTOR WITH CONTROLLED THERMAL AND MECHANICAL STRESSES AND UTILIZING PYROPHORIC IGNITION

[75] Inventors: Stephen Eisenhawer, Albuquerque; Anthony J. Mulac, Bernalillo County; A. Burl Donaldson; Ronald L. Fox, both of Albuquerque, all of N. Mex.

[73] Assignee: Enhanced Energy Systems, Albuquerque, N. Mex.

[21] Appl. No.: 753,800

[22] Filed: Jul. 8, 1985

Related U.S. Application Data

[63] Continuation of Ser. No. 489,855, Apr. 29, 1983, abandoned.

[51] Int. Cl.[4] ..... F23J 7/00

[52] U.S. Cl. ..... 431/4; 431/190; 431/114; 431/158; 239/424.5; 166/59

[58] Field of Search ..... 431/4, 6, 158, 190, 431/242, 243, 267, 353, 354, 114; 60/39.55, 39.53, 39.05; 166/59, 260, 302; 239/419.5, 424.5, 427; 261/16, 18 A, 117

[56] References Cited

U.S. PATENT DOCUMENTS

| | | | |
|---|---|---|---|
| 1,394,377 | 10/1921 | Vallely | 239/427.5 |
| 4,125,360 | 11/1978 | Culbertson | 431/4 |
| 4,159,743 | 7/1979 | Rose et al. | 166/59 |
| 4,173,449 | 11/1979 | Israel | 431/190 |
| 4,336,839 | 6/1982 | Wagner et al. | 431/158 |
| 4,366,860 | 1/1983 | Donaldson et al. | 166/59 |
| 4,385,661 | 5/1983 | Fox | 431/158 |
| 4,411,618 | 10/1983 | Donaldson et al. | 431/158 |
| 4,463,803 | 8/1984 | Wyatt | 431/158 |

FOREIGN PATENT DOCUMENTS

| | | | |
|---|---|---|---|
| 180350 | 5/1954 | Austria | 239/424.5 |
| 412318 | 1/1934 | United Kingdom | 239/424.5 |

OTHER PUBLICATIONS

Project Deep Steam Quarterly Reports—Oct. 1,1981—Mar. 31, 1982.

*Primary Examiner*—Samuel Scott
*Assistant Examiner*—Noah Kamen
*Attorney, Agent, or Firm*—Francis J. Lidd

[57] ABSTRACT

A steam generator having substantial thermal capacity for producing high quality steam used primarily for downhole steam generation in tertiary oil recovery. Incorporated in the generator is a novel high pressure, high heat release combustor, utilizing high pressure gaseous fuel and compressed gas oxidizer such as air, wherein thermal and mechanical stresses on the combustor structure are controlled. A method for controlling combustion induced mechanical stresses on the combustor through fluid injection is also disclosed. Disclosed designs provide substantially increased combustor life in "Downhole" Steam Generation service. The burner employs an ignition technique utilizing gaseous injection of a pyrophoric compound such as triethylborane (TEB).

8 Claims, 6 Drawing Figures

STEAM GENERATOR HAVING A HIGH PRESSURE COMBUSTOR WITH CONTROLLED THERMAL AND MECHANICAL STRESSES AND UTILIZING PYROPHORIC IGNITION

This is a continuation of co-pending application Ser. No. 06/489,855 filed on Apr. 29, 1983, abandoned.

BACKGROUND OF THE INVENTION

This invention relates to steam generation by direct contact between high temperature gases produced by combustion of gaseous hydrocarbon fuels such as natural gas and an oxidizer such as compressed air and water. The invention also provides a method of igniting a high pressure gaseous fuel/oxidizer burner uitlizing a pyrophoric compound with alternate combustor configurations. The disclosed steam generator is of improved construction and utilizes fluid injection for varying combustion processes in situ, resulting in substantially increased operational periods when generating steam for tertiary oil recovery in downhole combustion.

Techniques for thermal recovery of oil have been known for a substantial period of time. Although above ground steam generation and introduction into wells, also known as "steam drive", is in common use, the technique suffers from substantial limitations, particularly in deeper wells. Included in these limitations is the loss of heat due to long flow paths from the steam generator to the oil bearing strata or sands containing oil requiring steam injection for recovery.

Direct fired downhole steam generation such as disclosed in U.S. Pat. No. 2,548,606, (known as DFDSG) overcomes many of the above mentioned difficulties. In U.S. Pat. No. 2,548,606, hereby incorporated by reference is typical of conventional DFDSG's. However, the system disclosed typically displays substantial operating difficulties, culminating in short burner runs and substantially reduced "recovery."

High pressure combustion and steam generation encountered in downhole recovery also presents additional difficulties, including ignition, and corrosive deterioration of the burner assembly. Additional approaches to downhole recovery are disclosed in U.S. Pat. No. 2,839,141. This approach generates steam at the surface.

Known direct fired downhole steam generators have encountered certain operating difficulties resulting in reduced operating times, and relatively short equipment life, particularly that of the combustor. An example of the substantially limited life of direct fired downhole steam generators (DFDSG) is contained in reports published by the Sandia National Laboratories, working under contract to the United States Department of Energy. These reports, titled "Air/Diesel Steam Generator Fuel Test Interim Report" dated June 10, 1982, and "Oxygen/Diesel Steam Generator Field Test Interim Report" dated June 10, 1982, and Project Deep Steam Quarterly Reports Oct. 1, 1981–Mar. 31, 1982, indicate the deterioration of a DFDSG. More particularly, damage to areas adjacent to the combustor can and occurrences of "map" cracking are shown as examples of the deterioration of known generator designs. A further difficulty pointing up the lack of reliability when utilizing glow plugs for ignition is also indicated in these reports. Igniting the burner of a "downhole" generator in situ, as indicated above, is therefore an additional and substantial problem with known equipment.

U.S. Pat. No. 3,456,721 discloses a DFDSG unit employing a ceramic liner and conventional electrical ignition. In situ life of the electrical ignitor and associated difficulties are limited due to the high downhole fuel/oxidizer pressures resulting in limited actual combustion time downhole. Life of the ceramic liner disclosed is also limited in the downhole environment.

As indicated above, ignition of the combustor utilized in high pressure downhole steam generators is difficult and complicated. Difficulties arise since the energy required to ignite even stochiometric mixtures is great when both fuel and oxidizer mix at high pressures and flow rates. The conventional spark ignition at high pressures is impractical due to the distances from a power source, and the large sparking potentials required.

Use of resistance heaters known as "glow plugs" provides the bulk of presently used ignitors and avoids certain of the problems encountered. However, subsequent high temperature combustion after ignition greatly reduces usable life of these units. Therefore, in order to provide economic and long term combustion "runs" of a downhole steam generator, a non-deteriorating source of ignition energy as disclosed herein is a substantial advance in the ignition art.

U.S. Pat. No. 2,941,595 discloses a method and structure for spontaneous ignition of a burner utilizing premixed gaseous fuel/oxidizer. However, the ignitor disclosed is a solid metal phosphide, requiring contact with water in order to produce temperatures sufficient for ignition of the fuel and air mixture. Utilizing a solid ignitor also requires use of an additional fluid and makes positioning of the igniting material difficult to introduce and/or control. In the pyrophoric technique disclosed, these shortcomings are overcome and precise introduction and control of an igniting mixture is provided.

It is therefore an object of this invention to provide a direct fired downhole steam generator utilizing designs which minimize thermal and/or mechanical stresses.

It is a further object of this invention to provide a direct fired downhole steam generator where combustion pulsations are controlled, thereby minimizing structural fatigue of the burner components without sacrificing burner output or efficiency.

It is an additional object of this invention to provide a method of controlling a direct fired downhole steam generator through the use of injected fluids such as water, in order to modify the ongoing combustion process.

It is a further object of this invention to provide a direct fired downhole steam generator utilizing natural gas as a fuel and air as an oxidizing agent, which overcomes difficulties encountered in presently used units through use of a construction providing improved ignition and substantially increased life of the incorporated burner.

It is a further object of this invention to provide a high pressure combustor for a direct fired downhole steam generator, utilizing high pressure gaseous fuel and compressed air as an oxidizer, which is ignited through the controlled introduction of a pyrophoric material.

It is a further object of this invention to provide a method for effective and controlled introduction of a pyrophoric fluid for ignition of a high pressure combustor utilizing gaseous fuel and oxidizer.

It is a further object of this invention to provide a direct fired downhole steam generator having a high pressure combustor and utilizing gaseous fuel, oxygen as an oxidizer, and ignited by controlled introduction of a pyrophoric fluid.

SUMMARY OF THE INVENTION

The unsatisfactory life of known DFDSG burners has been discovered to be related to combined thermal strain due to combustion processes and generator feedwater injection, and mechanical forces applied to the combustor structure by hypersonic pulsations resulting from high intensity, high pressure combustion. Ensuing fatigue failure has been clearly demonstrated.

Applicant's discovery provides a means to optimize combustor performance in order to provide required output, high overall efficiency, and substantially increased life of the combustor. Presently used units do not contemplate the overall effects of high heat release, high pressure operation, and/or the thermal strain due to the high combustor thermal output required. Applicant's discovery as disclosed herein employs a generator design incorporating optimized combustion in order to provide high combustor output, high thermal efficiency, and extended combustor life.

As indicated by difficulties involved with state of the art downhole fired steam generators, control of combustion has been found to be a difficult task. Generally speaking, the phenomenon of high pressure, high turbulence, and high heat release combustion combined with direct contact steam generation, has involved multiple and complex processes, each a relatively unknown phenomena. Utilization of these processes in concert has generally resulted in equipment which is substantially less than optimized, primarily incorporating designs achieved through "cut and try" processes. The invention disclosed herein however, incorporates discoveries by the applicant which provide structure and techniques and/or methods for control and therefore adjustment, of the processes involved.

Applicant's discovery is embodied in the DFDSG disclosed herein. In this unit, control of fuel/oxidizer convective mixing provides a method of varying the combustion process within the combustor can. The disclosed structure accomplishes this control of the combustion process by use of angularly disposed oxidizer passages. Fuel is introduced in relation to the oxidizer jets so as to control the progressive combustion which follows ignition and confine it to a predetermined portion of the combustor can. As will be discussed later, the angle of impingement between the oxidizer jets and fuel inlet paths provides means for optimizing the location and size of the combustion reaction within the combustor can.

In particular, Applicants' discovery establishes concepts relating the above mentioned angle of incidence and its' criticality in obtaining a satisfactory DFDSG in that, angles either smaller or larger than the optimum result in unstable combustion or extension of the process outside the combustor can. In the former case, unstable combustion results in increased pulsations, thereby increasing mechanical strain and reducing burner life. In the latter case, combustion beyond the confines of the combustor can results in poor combustion efficiency and reduced steam generation, since feedwater and combustion gases are mixed before combustion is complete.

The direct fired downhole steam generator disclosed utilizes a combustor operating on compressed gaseous fuel such as natural gas, and an oxygen bearing oxidizer such as compressed air. As discussed, the disclosed combustor optimizes fuel/oxidizer introduction providing a long lived efficient unit having high output. A pyrophoric fluid is introduced at the fuel inlet adjacent to the fuel and oxidizer mixing zone. The method of introduction achieves controlled concentration of the igniting fluid to insure combustion of a relatively large volume of fuel/air mixture within the combustion container or "can".

An additional discovery by the applicant involves the utilization of small amounts of water or similar fluid added to the combustion processes by pre-injection into the gaseous fuel steam, with subsequent injection and convective mixing internal of the combustor can. It has been found that water injection as disclosed provides a further means to optimize the combustion within the disclosed structure, and to control mechanical stresses induced through ultrasonic pulsations associated with the combustion process.

In accordance with the invention, introduction of the pyrophoric fluid in a combustor utilizing gaseous fuel and oxidizer, is accomplished by a method wherein the pyrophoric fluid, in this case triethylborane (TEB), is contained for selective introduction into the combustion zone. Control of the TEB is enhanced through the use of an intermediate fluid, nonreactive with the TEB, which allows accumulation of a predetermined volume and accurate injection into the burner.

DETAILED DESCRIPTION OF THE INVENTION

Figure 1:
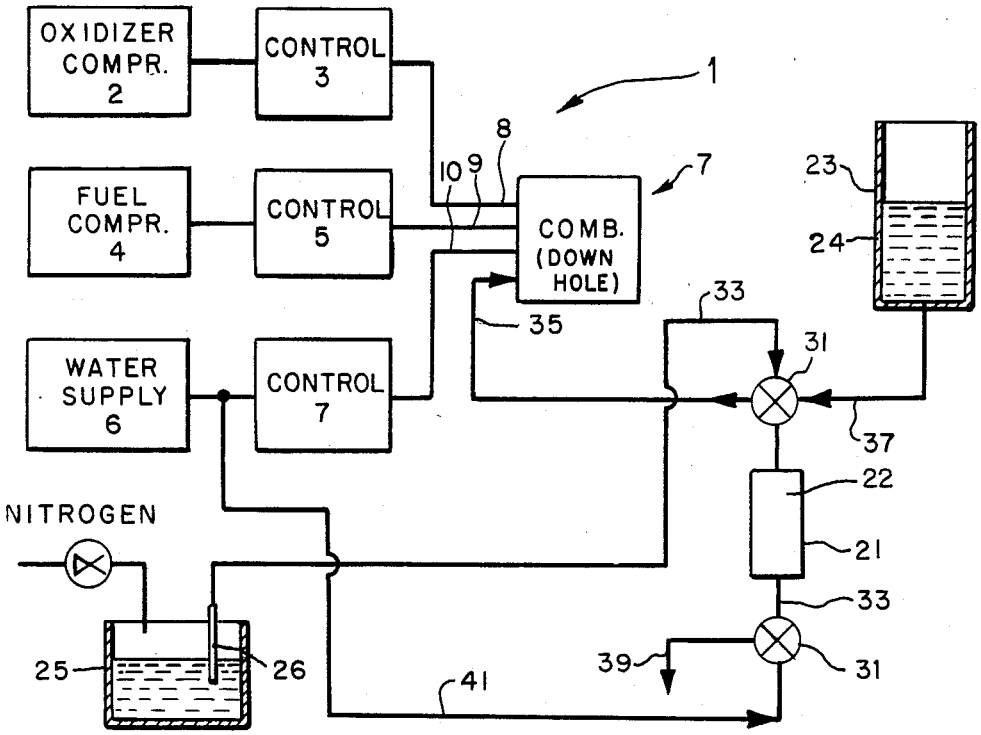
FIG. 1 is a semi-schematic system diagram showing the support and control systems for the disclosed steam generator utilized in downhole service incorporating pyrophoric ignition.
Figure 2:
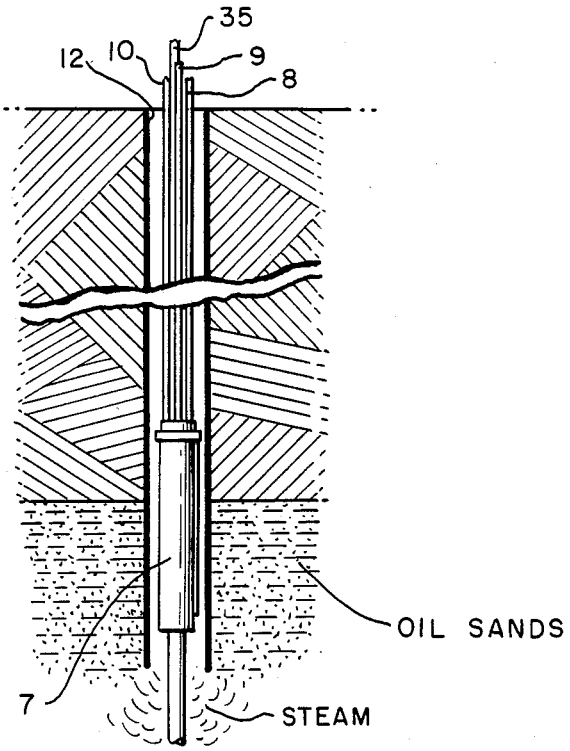
FIG. 2 is a semi-schematic section of a typical steam injected well, particularly showing the generator in place.
Figure 3:
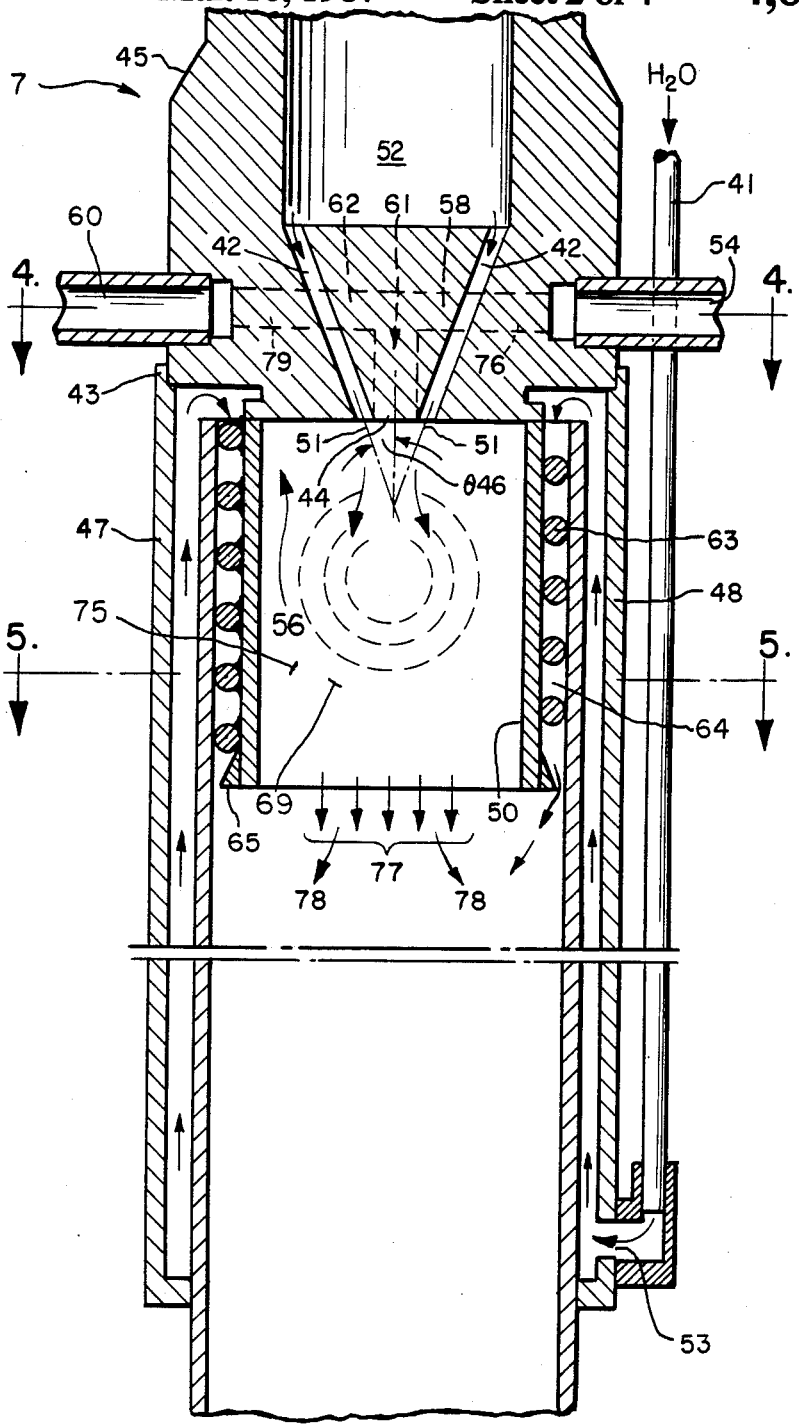
FIG. 3 is a detailed drawing of the steam generator disclosed, particularly showing details of convective mixing of the fuel, oxidizer, and pyrophoric material.
Figure 4:
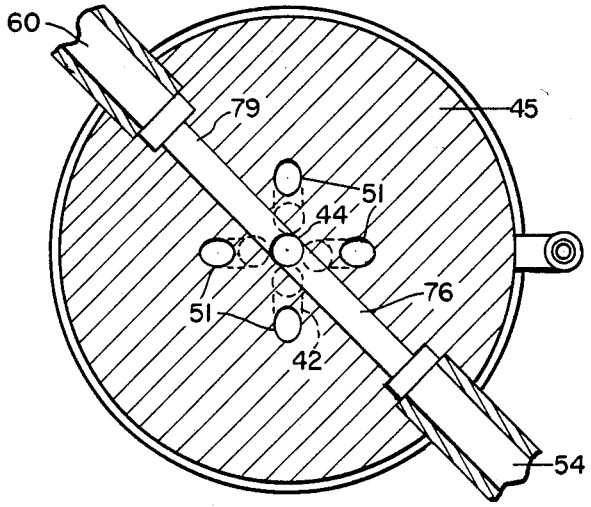
FIG. 4 is a sectional view of the burner of FIG. 3 particularly showing fuel and air channels.
Figure 5:
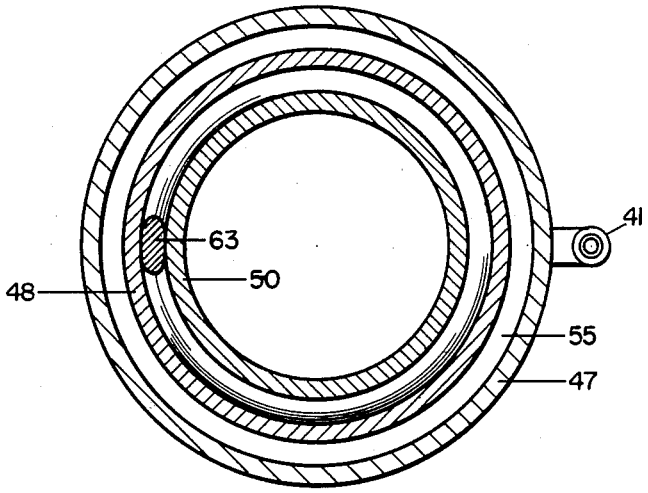
FIG. 5 is an additional detailed section showing a section of the disclosed generator showing annular water channels and combustor can.

Operation of the disclosed DFDSG 7, is best understood by reference primarily to FIGS. 3, 4, and 5, with occasional reference to FIGS. 1 and 2. As shown in FIG. 3, the combustor consists of a head or upper section 45, defining a gaseous oxidizer inlet 52, a pyrophoric ignitor inlet 60, and a fuel inlet 54. The ignitor inlet 60 and fuel inlet 54 intersect at location 61 via orifices 58 and 62. The combustion head further defines oxidizer combustion zone inlets or ports 51. It should be noted that although these inlets are disclosed in a configuration utilizing four inlet orifices, other configurations are contemplated including a configuration utilizing three orifices equally spaced on the circumference of a circle, said circle coaxial the fuel inlet and under certain conditions would provide proper operation.

The oxidizer inlet passages 42 terminating in the orifices 51 are angularly disposed relative to the longitudinal axis of the burner at a predetermined angle ($\theta$) 46. Applicant has discovered that preferred angle or magnitude of $\theta$ is approximately 15°, although variations in fuel, pressure, and the unit heat capacity dictate a variation in angle from 10° to 45°.

As discussed above, the fuel and ignitor inlet orifices are 58 and 42 respectively, terminating or merging to provide a fuel inlet passage 61, which terminates in a combustion gas inlet orifice 44. Therefore, the mixed combustion gas and oxidant passes through the combustion zone 69 via orifice 44, and 51.

The pyrophoric inlet 60 terminating in the intersecting inlet orifice 62 is further utilized as means to introduce a liquid combustion moderator such as water, after combustion has been initiated. As discussed above, it has been discovered that controlled amounts of liquid water introduced at this point in the combustion process provide a means for in situ control of the combustion process. This form of control results in substantial improvement in combustion efficiency, heat release, and more importantly in the combustion pulsation phenomenon.

Figure 6:
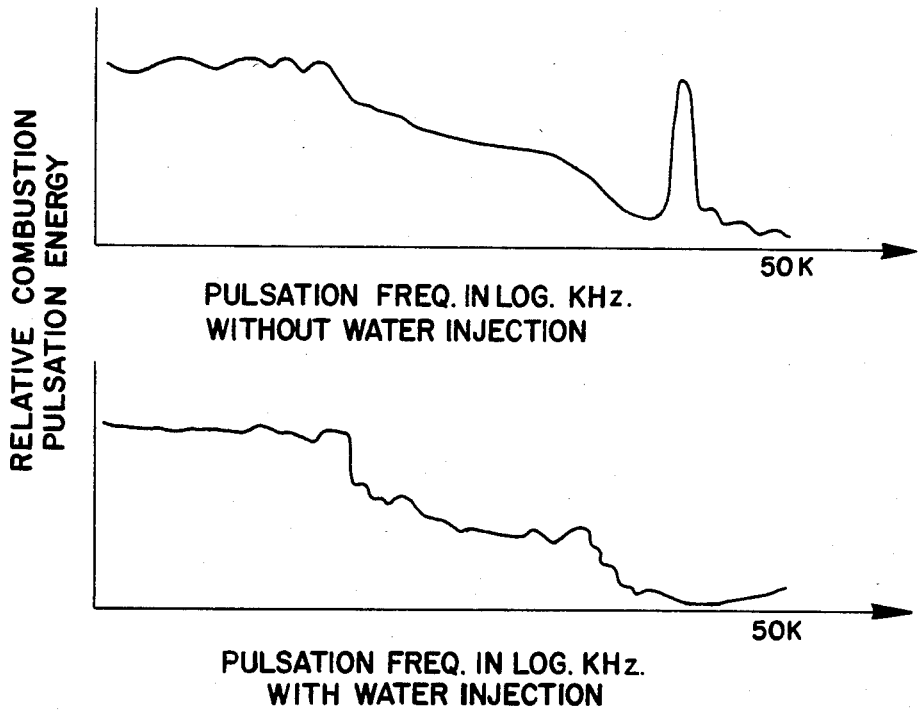
FIG. 6 is a combustion pulsation energy/pulsation frequency plot particularly showing reduction in destructive pulsation energy through use of the disclosed invention.

It has further been determined that the combustion pulsations inherent in high turbulence, high heat release combustion can produce mechanical fatigue in burner components (ref. FIG. 6). Therefore, control of the pulsation phenomenon contributes substantially to burner life as well as efficiency and output.

Feedwater introduced via channel 41 disposed longitudinally beyond the combustion zone passes through orifice 53 where the feedwater flow is reversed and travels through an annular flow passage or water channel 55. Annular water channel 55 is defined by the generator outer sleeve 47 coaxial of combustor inner sleeve 48 and the combustor can 50. An additional annular water channel or combustor can inner sleeve feedwater flow passage 64 is defined by coaxially disposed combustor inner sleeve 48 and combustor can 50.

The combustor can outer sleeve 47 is coaxial the generator head upper section 45, joining the lower portion of the combustor head 45 at the upper end of the combustor outer sleeve 47 at an intersection 43. The lower end of the combustor outer sleeve 47, is concentric of and abuts the combustor inner sleeve 48 at its lower end, adjacent to the steam generator feedwater inlet or flow control orifice 53, defining a feedwater intermediate flow channel 55, as introduced above.

In operation, gaseous oxidizer introduced through inlet 52 divides through the plurality of oxidizer inlet passages 42, intermediate the oxidizer inlet channel 52 and outlet orifice 51, providing an oxidizer outlet internal of the combustion chamber 75 at its upper end. Gaseous fuel enters the combustor head through passage or generator fuel inlet 54, at a pressure at or slightly greater than the oxidizer pressure. Fuel from the inlet 54 flows through generator head fuel passage 76, terminated by the generator fuel outlet orifice 44. Similarly, an ignitor inlet 60 communicates with passage 79 which in turn is terminated by the ignitor inlet orifice 62. The central fuel/ignitor channel 61 communicates the fuel inlet port 58, and ignitor inlet port 62 and combustion fuel chamber 75, via a combustor inlet orifice 44 located adjacent the oxidizer inlet ports 51.

As shown in FIG. 4, the oxidizer inlet ports 51 are disposed about the fuel/ignitor inlet port 44 in the upper end of the combustor head 45.

In the disclosed configuration, gaseous oxidant enters the combustion chamber 75 via the orifice 51, while gaseous fuel enters the fuel/ignitor inlet port 44 oxidant and fuel pressures are such that convective mixing is obtained in the combustion area at a predetermined location 69 within the combustion chamber 75. As indicated above, the intersection angle of oxidizer inlet channels 42 with the longitudinal axis of the combustor can is critical in determining the location of combustion, i.e. 69, within the chamber 75, the applicant having discovered that containing and completing combustion within the combustor can provides high efficiency, and improved output.

Assuming that gaseous fuel and oxidizer are flowing and entering the combustion chamber as indicated above, a pyrophoric fluid such as triethylborane is introduced through the ignitor inlet port 60, in a manner to be described later. Predetermined amounts of properly distributed pyrophoric fluid and gaseous fuel are convectively mixed adjacent their respective inlet ports, i.e. 62 and 58, entering the combustion chamber in a premixed condition via the inlet orifice 44. On entering the combustion chamber, due to the convective mixing process, the ignition fluid combines with the oxidizer somewhere in the vicinity of the upper inlet orifices, i.e. 51 and 44, whereupon the pyrophoric fluid oxidizes raising the mixture to the ignition point of the gaseous fuel/oxidizer mixture, and initiating the combustion process.

As combustion proceeds, the process traverses the combustor can being essentially complete, prior to reaching the feedwater/combustion gas mixing zone 77.

Steam is generated in the mixing zone 77 through the discharge of water from the concentric flow passage defined as indicated above by the combustor can 50 and the combustor inner sleeve 48, the feedwater entering the mixing zone 78 after passing through a somewhat circular flow control orifice 65 disposed near the lower end of the combustor can 50. It should be noted that the feedwater follows a helically turbulent path as it traverses the flow passage defined by the combustor can inner sleeve 48 and the combustor can 50, since a helically wrapped turbulator 63 having a somewhat cylindrical cross-section, produces helical flow within the channel 64 prior to its discharge via the flow control orifice 65 into the mixing zone 78.

Typically, for a burner utilizing natural gas as a fuel operating at 1500 pounds per square inch pressure, and atmospheric air operating at 1500 pounds per square inch, and utilizing feedwater flows of 20 gallons per minute, 1200 pounds of steam per hour are produced at 1450 pounds per square inch pressure having a quality of 70%.

Utilizing the combustor described above, applicant has discovered that in addition to controlling the combustion location within the combustor can, injection of water via the ignitor port 60 at a pressure of 1500 pounds per square inch and a flow rate of 0.10 gallons per minute, combustion pulsations can be adjusted in order to further minimize combustion induced pressure pulsations on the burner assembly. As it has been determined in prior art burners, these pulsations occurring simultaneously with elevated temperatures produce a combination of stresses on the combustor material which in early units resulted in early failure. These are clearly shown in the Department of Energy reports incorporated by reference. As shown in FIG. 6, measurement of combustor can vibration, a quantity directly related to combustion pulsation, indicates reduced amplitude through controlled injection of fluids such as water.

Thus, applicant has discovered that the combination of predetermined angular disposition of the oxidizer inlet ports in relation to the gaseous fuel inlets, and introduction of predetermined amounts of water provide a means for greatly reducing combustor strain and in turn substantially increasing life of the direct fired downhole steam generator unit.

As indicated in FIG. 2, the generator of the invention operates in a conventional well casing 12 of an existing well. The burner is located at a predetermined depth in the well, the exact location dictated by downhole location of oil bearing strata or oil sands. In position, the burner 7 communicates with the above ground system 1 via conduits 8, 9, 10, and 35 as indicated above. With this arrangement, generator output is injected into the appropriate oil bearing strata providing the required steam drive, thereby improving the output of adjacent wells interconnected by the above mentioned oil bearing strata.

In keeping with an additional aspect of the invention disclosed, ignition of the fuel/air mixture internal of the combustor can 50 in the vicinity of point 69 is initiated by prior adjustment and injection of the pyrophoric fuel inlet system as follows.

A pyrophoric fluid such as triethylborane is stored in oxygen-free container 25 (ref FIG. 1). Exclusion of oxygen is assured by maintaining an atmosphere of nitrogen or other inert gas above the stored TEB. The nitrogen further serves to provide a driving force for removal of TEB to be described later.

The dip tube 26 having its lower end submerged in the TEB communicated with a multiway valve 31 via conduit 33. A charge cylinder 21 communicates with multiway valve 31 at its upper and lower ends. The upper multiway valve 31 is in fluid communication with an intermediate fluid container 23 storing an intermediate fluid 24 such as water. The lower multiway valve 32 communicates with the high pressure water supply 6 via conduit 41. Lower multiway valve 32 further communicates at a preselected position with a water drain 39 preferably to the atmosphere.

In operation, with air or other oxidizer, fuel and water supplied to the burner 7 via conduits 8, 9, 10, and 35 as described above, the charge cylinder 21 has been filled with water via lower multiway valve 31. Multiway valve 31 are now adjusted to admit intermediate fluid 24 from container 23 and venting container 23 via lower valve 31, through outlet or drain 39, thereby completely filling the charge container 21 with the intermediate fluid 24. At this point, multiway valves 31, 32 are readjusted to admit a predetermined amount of pyrophoric fluid, i.e. TEB to the container 21 via dip tube 26 and conduit 33. Assuming that fuel, air and water are flowing into the burner assembly 7 as indicated above, multiway valve 31 are again adjusted to force the predetermined amount of pyrophoric liquid 22 contained in 21 into the inlet of conduit 35 using the pressure of water supply 6, whereby it enters the burner via inlet or port 60 passing through check valve 61, entering the combustor via port 62. (As shown, the intersection of the fuel outlet 51 at a pressure approximately 5% greater than the fuel pressure.)

It is apparent that there has been provided in accordance of the invention a high pressure steam generator that fully satisfied the objects, aims and advantages set forth above. While the invention has been described in conjunction with a specific embodiment or embodiments thereof, it will be evident to those skilled in the combustion arts that many alternatives, variations and substitutive modifications are apparent in the light of the above description. Accordingly, it is intended to contemplate all such alternatives, modifications and variations as fall within the scope of the appended claims.

Therefore we claim:

1. In a direct fired high pressure steam generator of the type having a burner base with means for supplying feedwater, gaseous fuel and oxidizer, and a feedwater cooled combustion chamber extending from said base along a common longitudinal axis, said base/chamber extension defining a chamber inlet end, said chamber generating high pressure combustion gases and having a section for generating steam by mixing feedwater and combustion gas, the improvement comprising;

a plurality of conduits in said base terminated by inlet ports defined by said inlet end, said conduits angularly disposed to said longitudinal axis of said base and chamber for directing gaseous oxidizer through said ports internal of said combustion chamber and in said base end for generating gaseous oxidizer jets, said jets intersecting entirely internal said chamber; and, a central fuel inlet port in said base and centrally adjacent said oxidant inlet ports for generating a central fuel jet, said jet intersecting said oxidizer jets and means for introducing water into said fuel inlet port so as to reduce vibrations caused by combustion.

2. The generator of claim 1 where said angular disposition has a range of 15°–45°.

3. Apparatus for downhole generation of steam and high temperature gases of the type having a water cooled combustion chamber and steam generating sections comprising;

a burner base with means for introducing gaseous fuel, oxidizer, and water, said base having supply and combustion ends and a central axis;

a plurality of oxidizer conduits in said base, said conduits angularly disposed about said base axis, having initial and terminal ends in said base supply and combustion ends respectively, said terminal ends defining oxidizer inlet ports in said base combustion end;

a fuel inlet passage in said base, communicating said supply and combustion ends, said base combustion end and fuel passage defining a fuel inlet port in said base combustion end, said port essentially coaxial said base axis;

a generally cylindrical open ended combustion chamber extending from and coaxial of said base combustion end, and surrounding said oxidizer and fuel inlet ports for containing fuel and oxidizer during combustion and further directing combustion gas flows through said open end;

a generally cylindrical open ended conduit extending from said base combustion end, said conduit telescoping said chamber and extending beyond said chamber open end, said extension defining a steam generator section downstream said chamber open end, said telescoped chamber outer surface and conduit inner surface further defining an open ended first flow passage for cooling said chamber and supplying water to said generator for producing steam;

an outer housing extending from and generally coaxial of said base combustion end, and partially surrounding said conduit, said housing inner surface and conduit outer surface defining a second flow passage in fluid communication with said first passage adjacent said base combustion end;

means in said second flow passage for admitting feedwater at a predetermined rate;

means admitting pressurized gaseous fuel and oxidizer at pressures in a range of 500 to 2000 pounds per square inch and in predetermined flow rate ratios to said feedwater rate to said base supply end;

means in said combustion chamber, for igniting fuel and air mixture;

wherein said base conduits and inlet ports angularly inject oxidizer and fuel flows for combustion within said combustion chamber, thereby generating high temperature gases, said gases exiting said chamber open end; and feedwater exiting said first passage open end generate high pressure steam through contact with said high temperature gases and means for introducing water into said fuel inlet port so as to reduce vibrations caused by combustion.

4. The apparatus of claim 3 wherein the axis of said oxidizer conduits and the base cylindrical axis are in a range of 10–45 degrees.

5. The apparatus of claim 4 wherein the burner further comprises three symmetrically spaced oxidizer inlet ports.

6. The apparatus of claim 27 wherein said introduced water is injected at a rate of 0.3 to 0.6 percent of the feedwater flow rate.

7. A method of improving the service life of a direct fired downhole steam generator, said generator having base means supplying gaseous fuel, water and oxidizer to said base, an outer cylinder and combustion chamber extending from said base, said cylinder surrounding and extending beyond said combustion chamber, said extension defining a steam generating section; and, conduit means in said base said conduit means supplying said gaseous fuel and oxidizer to said combustion chamber and feedwater to said steam generator, comprising the steps of;

supplying gaseous fuel pressurized in the range of 500 to 2000 pounds per square inch to said fuel conduit means;

supplying a gaseous oxidizer pressurized to the range of 500 to 2000 pounds per square inch;

supplying feedwater to said feedwater conduit means at pressures in the 500 to 2000 pounds per square inch range, and at a predetermined flow rate;

mixing said fuel and water through injecting water into said fuel conduit means, said water having a predetermined flow rate;

wherein ultrasonic pulsations generated by the combustion process are controlled.

8. The method of claim 9 further including the step of controlling said injected water flow rate to the range of 0.3 to 0.6% of said feedwater rate.

* * * * *